US006354229B1

(12) United States Patent
Heidtke

(10) Patent No.: US 6,354,229 B1
(45) Date of Patent: Mar. 12, 2002

(54) SHIPPING PLATFORM

(76) Inventor: Bruce T. Heidtke, Summit Pl., 250 Selby #45, St. Paul, MN (US) 55102

( * ) Notice: Subject to any disclaimer, the term of this patent is extended or adjusted under 35 U.S.C. 154(b) by 0 days.

(21) Appl. No.: 09/455,184

(22) Filed: Dec. 6, 1999

(51) Int. Cl.[7] ..... B65D 19/00
(52) U.S. Cl. ..... 108/51.3
(58) Field of Search ..... 108/51.3, 51.11, 108/56.3, 56.1

(56) References Cited

U.S. PATENT DOCUMENTS

| | | | | | |
|---|---|---|---|---|---|
| 2,444,183 | A | * | 6/1948 | Cahners | 108/51.3 |
| 2,446,914 | A | * | 8/1948 | Fallert et al. | 108/51.3 |
| 2,997,266 | A | * | 8/1961 | Munroe | 108/51.3 |
| 3,434,435 | A | * | 3/1969 | Achermann et al. | 108/51.3 |
| 3,626,860 | A | * | 12/1971 | Blatt | 108/51.3 |
| 3,839,970 | A | | 10/1974 | Keeler | |
| 4,714,026 | A | * | 12/1987 | Yamaguchi et al. | 108/51.3 X |
| 4,759,295 | A | * | 7/1988 | Nilsen et al. | 108/51.3 |
| 5,411,786 | A | * | 5/1995 | Kuo | 108/51.3 X |
| 5,433,156 | A | | 7/1995 | Hutchison | |
| 5,483,875 | A | * | 1/1996 | Turecek et al. | 108/51.3 |
| 5,528,994 | A | | 6/1996 | Iseli | |
| 5,531,165 | A | * | 7/1996 | Taravella et al. | 108/51.3 |
| 5,537,935 | A | * | 7/1996 | Otaguchi et al. | 108/51.3 |
| 5,595,125 | A | * | 1/1997 | Bridges, Jr. | 108/51.3 |
| 5,797,832 | A | * | 8/1998 | Ong et al. | 108/51.3 X |
| 5,921,187 | A | * | 7/1999 | Wang | 108/51.3 |
| 6,076,475 | A | * | 6/2000 | Kuhn et al. | 108/51.3 |

OTHER PUBLICATIONS

Protect the Environment and your Products with Cordeck® brochure.

Pack–A–Derm The First Valid Alternative to Wood Pallets brochure.

Buckboard Expendable Pallets brochure; Menasha Corporation.

Get the Most from your Buckboard Expendable Pallets brochure, Menasha Corporation.

Pillar Pallets brochure.

Payload™ Pallet the Premium Corrugated Pallet, photocopy of page from brochure; Smurfit Pallet Systems.

The Future in Pallets is Here, MPC Platform Systems brochure.

An Alternative to Wood, Do It Yourself Pallets are Made to Recycle, reprinted from Good Packaging Magazine, Nov. 1995.

Introducing the World's Most Advanced Pallet, LIN PAC, Inc. Pallet Division brochure.

Load Right Products "The Right Platform for the Load!™" brochure.

* cited by examiner

*Primary Examiner*—Jose V. Chen
(74) *Attorney, Agent, or Firm*—Nawrocki, Rooney & Sivertson, P.A.

(57) ABSTRACT

A shipping platform and method of producing such a device for use in the cargo-shipping industry. The platform has a planar deck structure with upper and lower surfaces. A plurality of support structures are arranged at predetermined locations under the lower surface of deck structure. Each of the support structures forms an open-ended channel cavity. At least one vertical support core is placed within the open ended channel of at least one of the support structures. The deck structure, the support structures, and the vertical support cores are secured together to form the shipping platform.

19 Claims, 12 Drawing Sheets

SHIPPING PLATFORM

BACKGROUND OF THE INVENTION

The present invention relates generally to the field of shipping devices. In particular, the invention relates to shipping platforms for use in the shipping of quantities of goods, and the methods of constructing such devices.

Structurally sound pallets are essential tools in the cargo-shipping industry throughout the world. Whether cargo is being shipped by land, sea, or air, the handling of cargo necessitates the use of a practical means of supporting and moving unit amounts of goods. Traditionally, shipping platforms have been constructed utilizing strong structural materials such as wood or metal to provide a stiff, damage resistant device. However, these devices generally have significant drawbacks.

For example, wooden shipping platforms are environmentally unfriendly. They are constructed from wood, which depletes forests to provide the necessary raw materials. The devices are also difficult to recycle. Many landfills refuse to take them, while others charge fees to dispose of them.

Furthermore, since traditional devices are constructed from materials such as wood or metal, the devices are heavy, weighing between 45 and 65 pounds. Transportation companies generally factor in the weight of these devices to determine the cost of shipping the goods, thereby costing the owner money each time the device is shipped.

Recently, devices have been proposed and developed using recyclable materials such as corrugated fibreboard or plastic. These devices although environmentally friendly, have generally not been affordable due to either, the amount of material necessary to produce a device having the structural strength necessary to replace traditional devices, or a platform design that requires many production steps or has many components to be assembled.

Therefore, there is a need in the field of shipping platforms for a product that is lightweight; easy to use, simple to assemble, and dispose of; yet still durable and cost effective to produce.

The present invention provides a device that is recyclable, constructed of lightweight material, efficiently designed to use minimal material while providing the structural strength necessary to replace traditional devices, and is easy to fabricate and assemble.

SUMMARY OF THE INVENTION

The present invention relates to a shipping platform for shipping a quantity of goods and a method of constructing such a device. The device is comprised of a deck structure, a plurality of support structures, and a vertical support core placed within at least one support structure.

The method of producing the device according to the present invention is comprised of several steps. At least one sheet of planar material must be provided. The material is creased to form a platform frame having a plurality of fold lines.

The material is then folded to form a shipping platform having a planar deck structure and a plurality of support structures. Each support structure is constructed and arranged to form an open-ended channel cavity therein. At least one vertical support core is provided and at least one of the vertical support cores is placed into one of the support structures. The shipping platform is then secured by attaching the planar deck structure, the vertical support cores, and the support structures together.

The above mentioned benefits and other benefits of the invention will become clear from the following description by reference to the accompanying drawings.

DESCRIPTION OF THE PREFERRED EMBODIMENT

Figure 1:
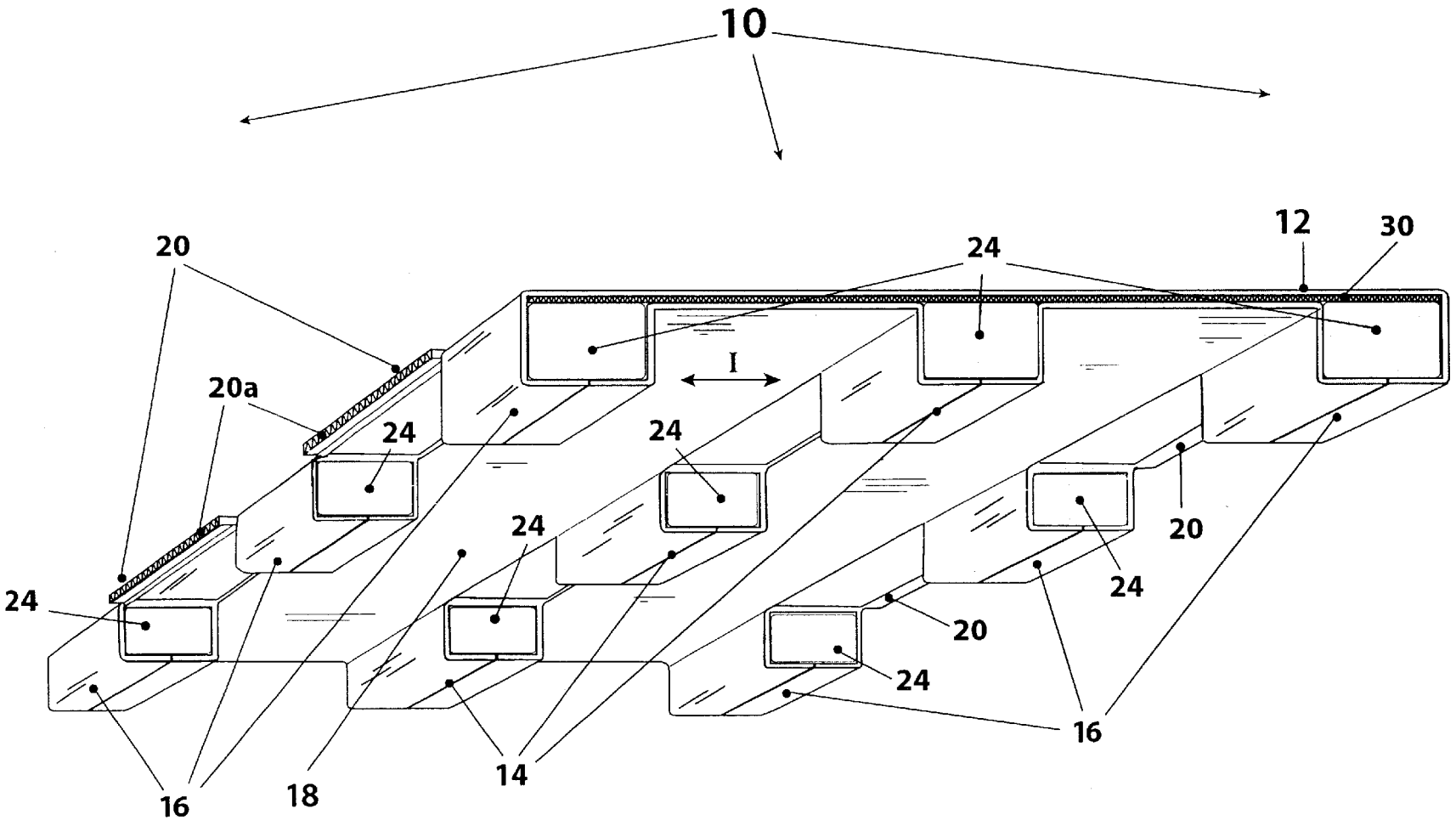
FIG. 1 is an upward angled perspective view of a preferred embodiment of the invention.
Figure 1A:
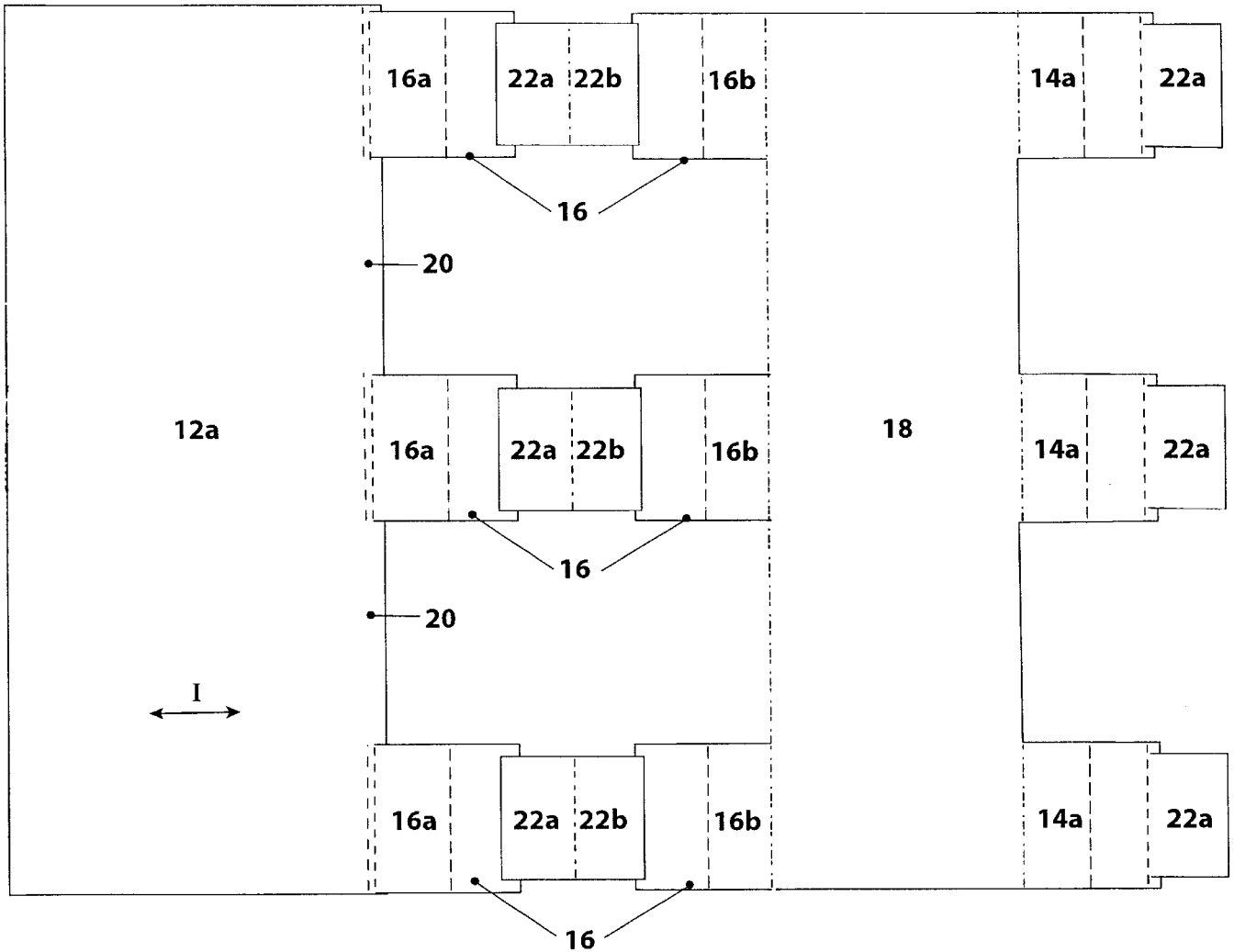
FIG. 1*a* is an overhead inside view of one sheet comprising one half of a platform frame of the embodiment represented in FIG. 1.
Figure 1B:
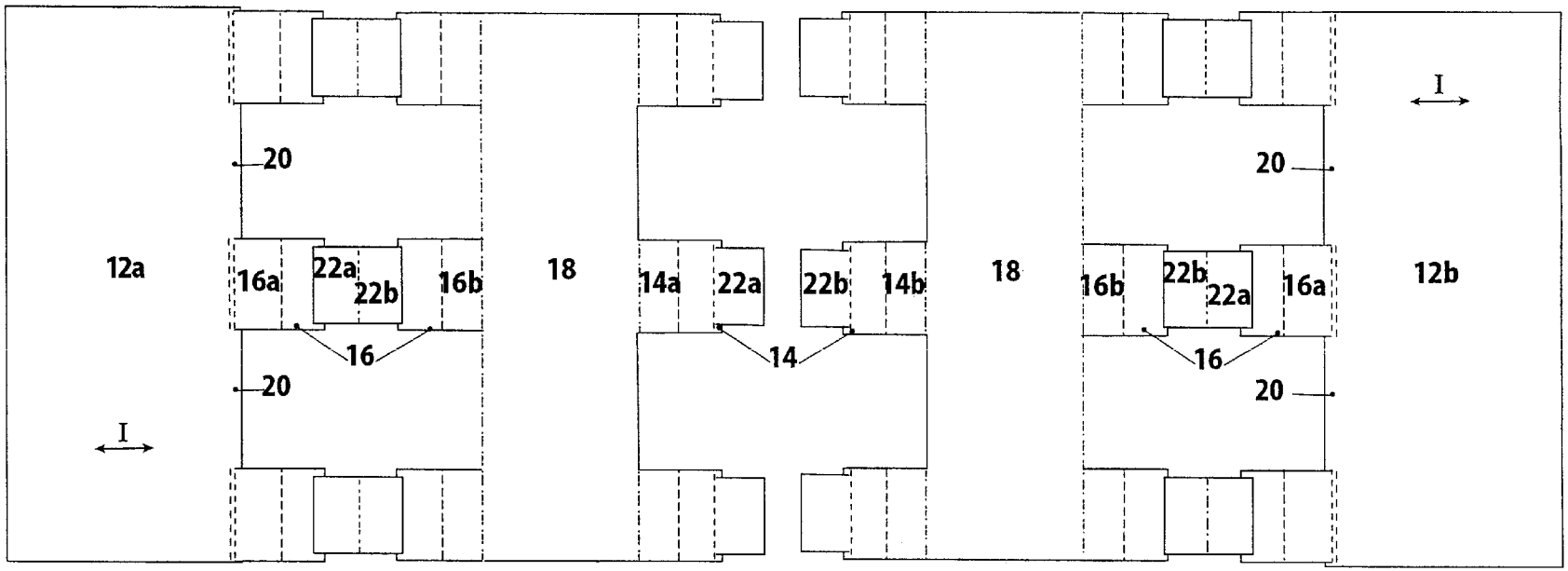
FIG. 1*b* is an overhead inside view of the two sheets comprising a platform frame of the embodiment represented in FIG. 1.
Figure 2:
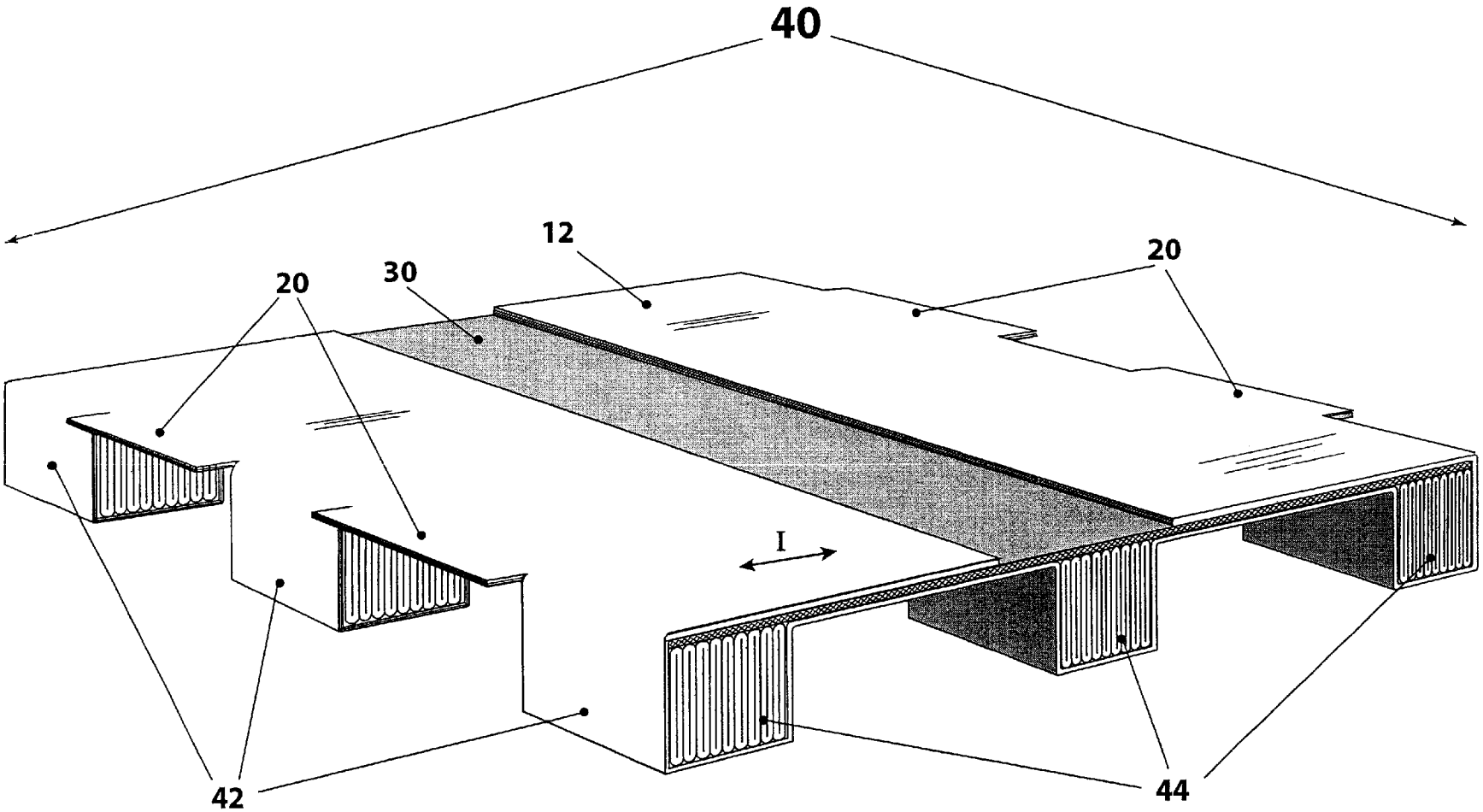
FIG. 2 is a perspective view of a second embodiment of the invention.

Shipping platforms 10 and 40, as shown in FIGS. 1 and 2, are constructed in accordance with the present invention. As illustrated, shipping platforms 10 and 40 are comprised of a deck structure 12 and a plurality of support structures 14 and 16, or 42 with each support structure forming an open-ended channel cavity therein. These portions of the shipping platform may be fabricated from a single sheet of material or from many sheets. For example, the embodiment shown in FIGS. 2 and 2*a* shows these portions designed from one sheet of material, whereas the embodiment shown in FIGS. 1, 1*a*, and 1*b*, has these portions constructed from two sheets of material.

Furthermore, the material used to fabricate the shipping platform may be any material suitable to achieve the objects of the invention, for example, cardboard, paperboard, fibreboard, plastic, or materials having similar structural qualities may be utilized within the purview of this invention. Preferably, the device is constructed of 275 pound, 350 pound, or 500 pound double-walled corrugated fibreboard material. Also, many of the suggested materials may be constructed having a direction of corrugation or grain. It is preferred that when multiple layers of material are utilized, the directions of corrugation or grain should be aligned perpendicular to those of its adjacent layers when possible. The directions of corrugation or grain are indicated in the figures with roman numerals and direction shown with a two-headed arrow.

Figure 2A:
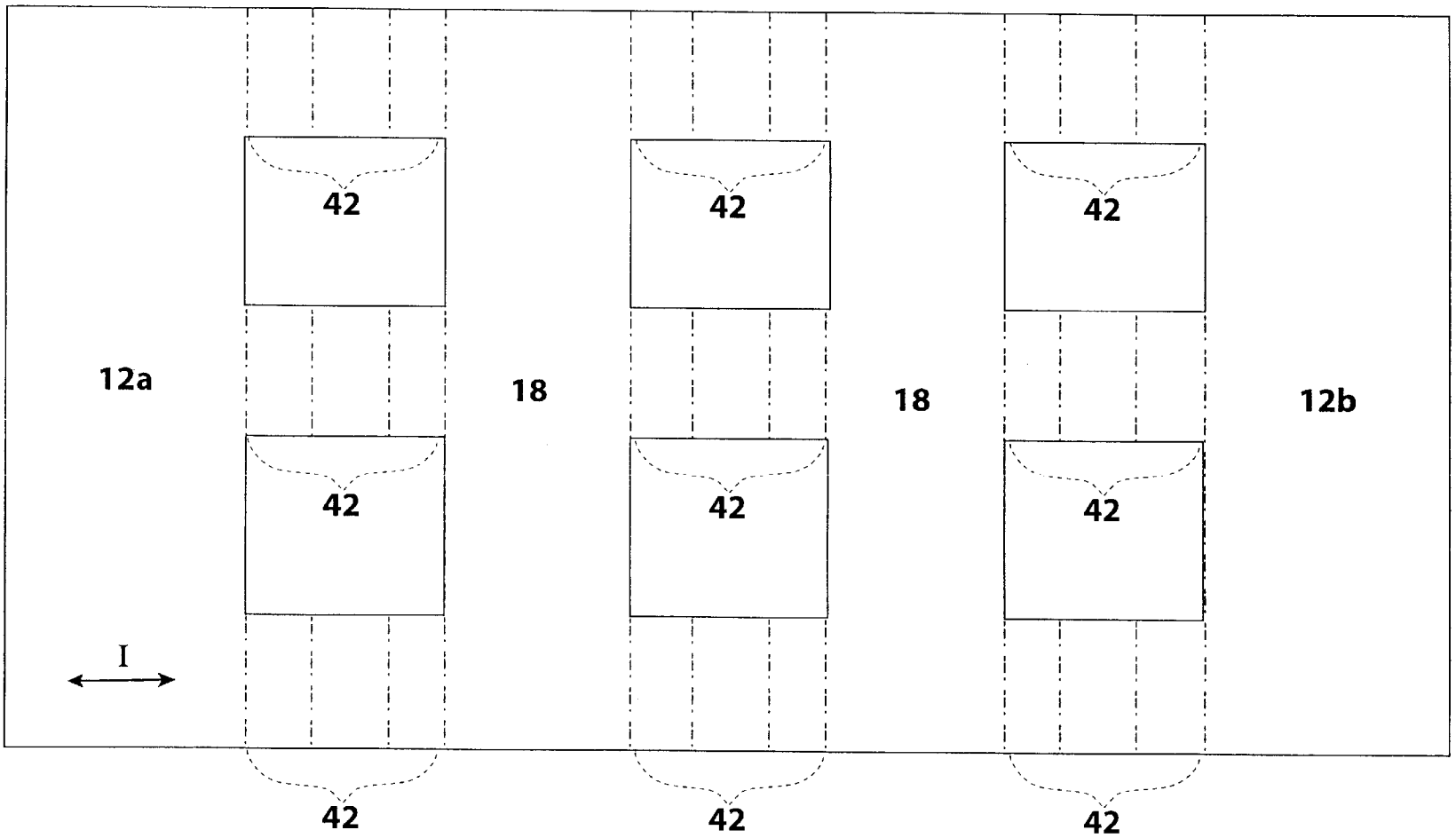
FIG. 2*a* is an overhead inside view of the platform frame of the embodiment represented in FIG. 2.

As shown in FIGS. 1–2*a* in addition to the deck and support structures, a vertical support core 24 or 44 is placed within the open-ended channel cavity of the support structures 14 and 16, or 42 to provide the primary vertical and shear strength to the support structures. Wood, metal, cardboard, paperboard, fibreboard, plastic, and other similar materials may be utilized to form the vertical support cores. Furthermore, any number of vertical support core configurations may be utilized within the purview of this invention.

Figure 3A:
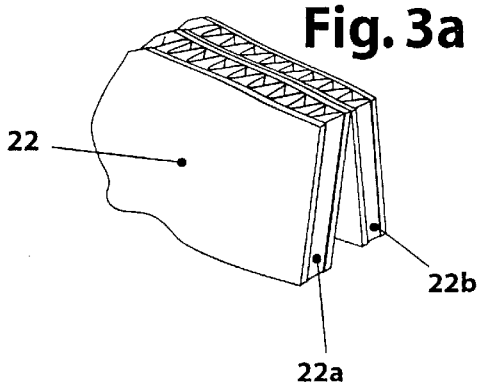
FIG. 3*a* is a cutaway view of the cleat structure during assembly of the embodiment represented in FIG. 1.
Figure 3B:
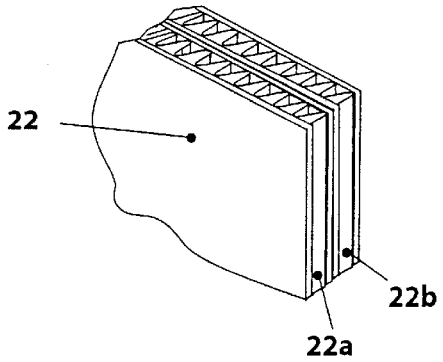
FIG. 3*b* is a cutaway view of the cleat structure of the embodiment represented in FIG. 1.
Figure 3:
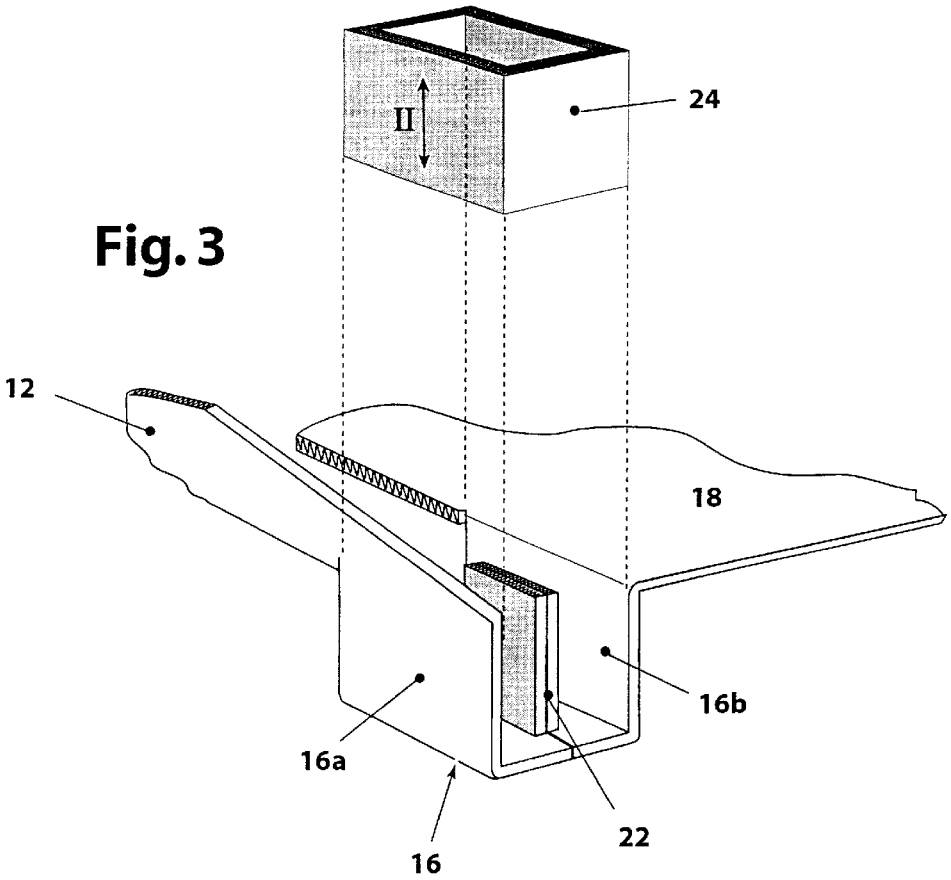
FIG. 3 is a cutaway view of the support structure and vertical support core prior to assembly of the embodiment represented in FIG. 1.
Figure 4:
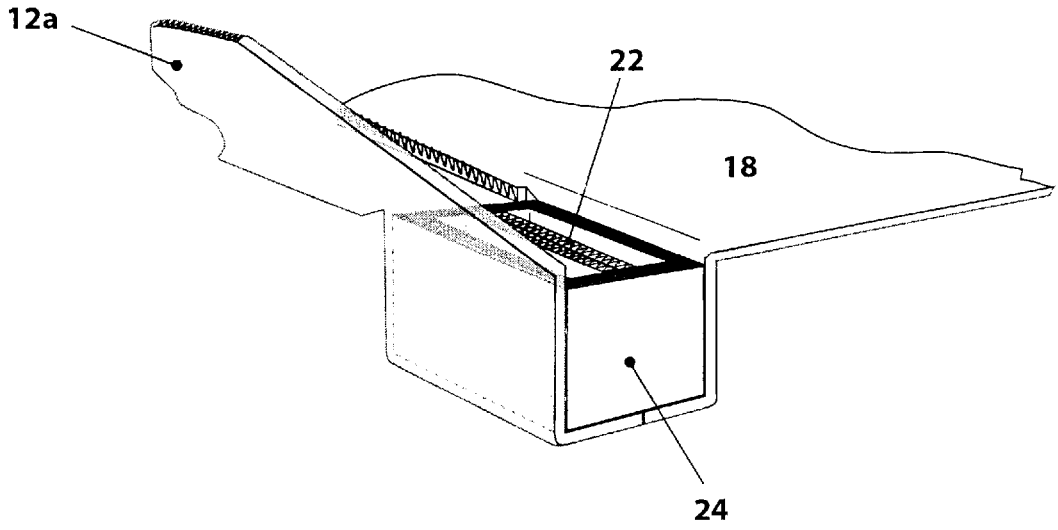
FIG. 4 is a cutaway view of the support structure, having the vertical support core in position, of the embodiment represented in FIG. 1.
Figure 5:
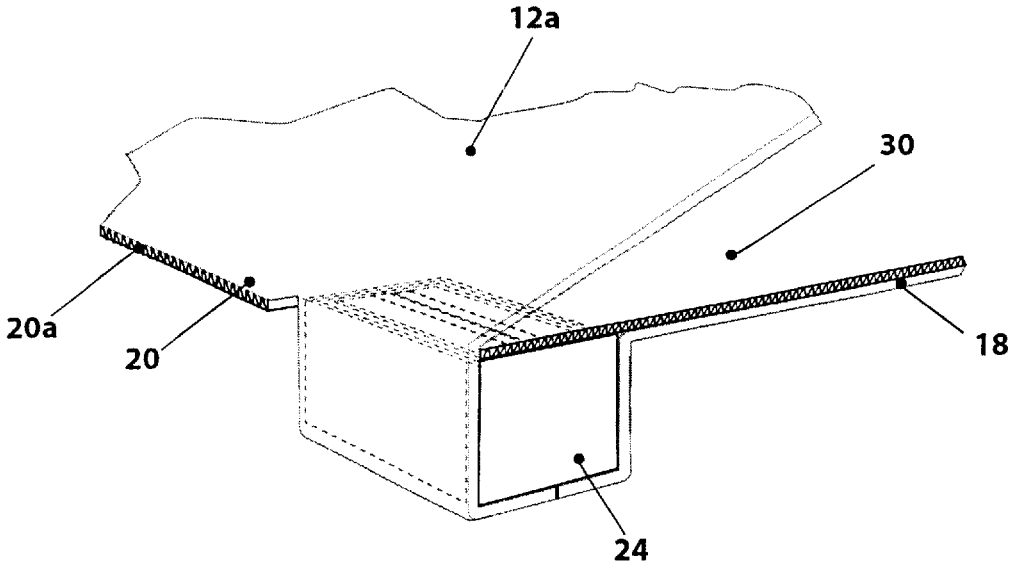
FIG. 5 is a cutaway view of the deck structure being placed over an optional deck pad and support structure with vertical support core of the embodiment represented in FIG. 1.
Figure 6:
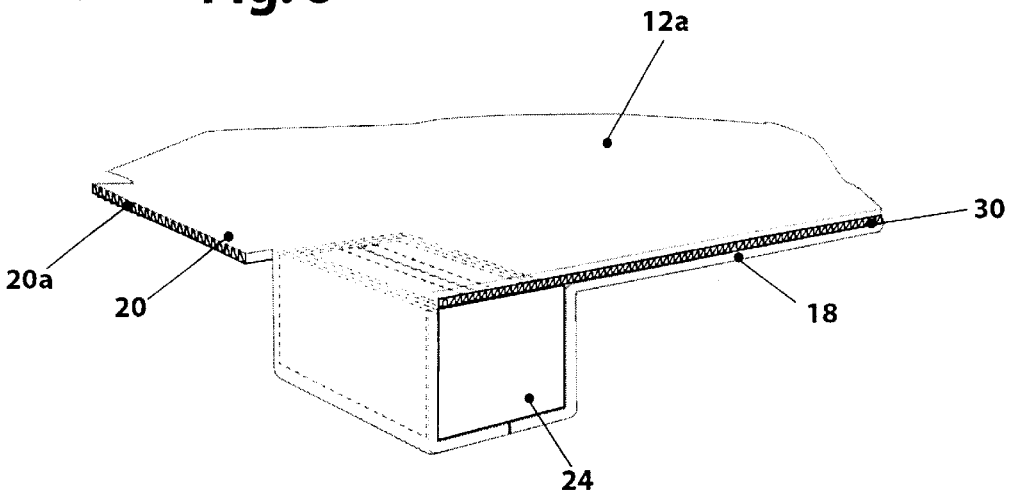
FIG. 6 is a cutaway view of the assembled support structure with vertical support core and option deck pad of the embodiment represented in FIG. 1.

For example, as shown in FIG. 2, a section of material may be folded accordion-style, indicated by 44, and placed within the support structure 42. Another example is shown in FIG. 1, wherein a rectangular vertical support core 24 having an opening in the center, as shown in FIG. 3, is placed into the open-ended cavity of the support structures 14 and 16. Denoted as II on FIG. 3, the direction of corrugation or grain in the vertical support structure should run up and down the sides of the structure. In this embodiment, the support structures 14 and 16 each preferably contain a cleat 22 formed within the open-ended cavity to provide further shear strength to the support structure.

The deck structure is constructed having a planar, generally polygonal shape. As shown in FIG. 1, a preferred shape for the deck structure 12 is rectangular. The deck structure may also be constructed to include stretch wrap retention tabs along its edges. These tabs 20 allow stretch wrap, to stay in position and not ride up and away from the shipping platform. The stretch wrap material unitizes the shipping platform to the load.

The device, as shown in FIG. 1, is preferably constructed from two sheets of material. One of these sheets is shown in FIG. 1*a*. A sheet of material, as shown, is die-cut to form one half of the embodiment shown in FIG. 1. The die-cutting preferably creases the sheet to create fold lines along which the different parts of the device are formed. Preferably, as shown in FIG. 3*b*, the lines between cleat sections 22*a* and 22*b* are perforated to create a hinge, thereby exacting the uniformity of the cleat structures 22.

In FIG. 1*b*, a second sheet of material, a mirror image of the one shown in FIG. 1*a*, is attached to the first sheet to form a single platform frame. The two sheets are attached by folding the cleat sections marked 22A and 22B upward, and attaching the standing surfaces facing each other together. This attachment forms a flat platform frame having three standing cleats formed along its center.

Figure 8:
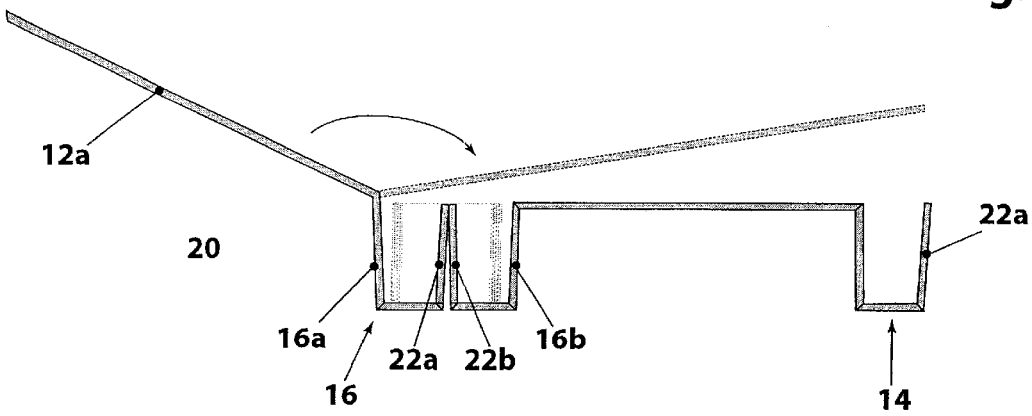
FIG. 8 is a front perspective view of the assembly of one half of the shipping platform of the embodiment represented in FIG. 1.
Figure 9:
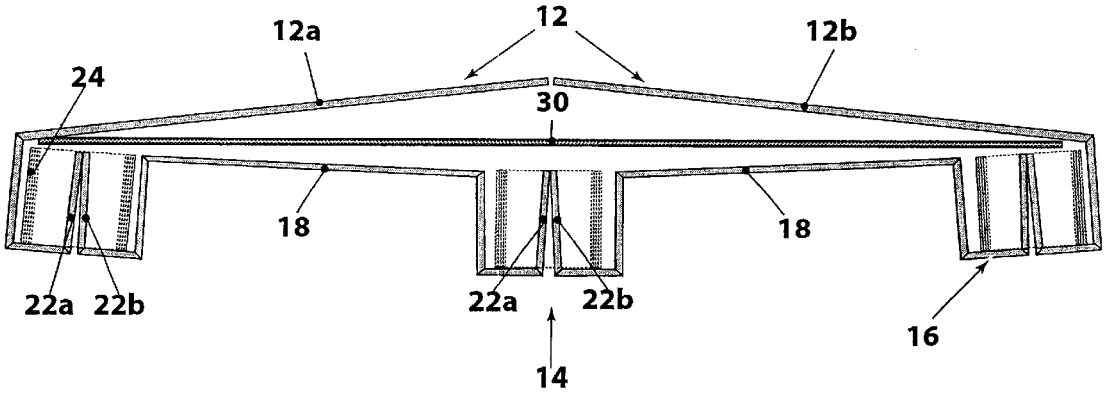
FIG. 9 is a front perspective view of the assembly of the shipping platform of the embodiment represented in FIG. 1 having an optional deck pad and vertical support cores inserted therein.
Figure 10:
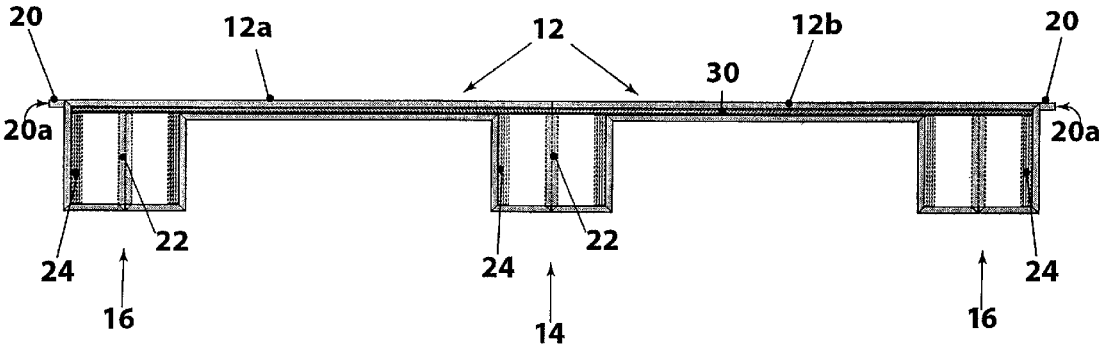
FIG. 10 is a front perspective view of the assembled shipping platform of the embodiment represented in FIG. 1.

As shown in FIGS. 1*a* and 8, the sheet of material comprises; one half of deck structure 12 indicated as 12*a*, one row of three outside support structures 16 each having a cleat 22, a deck support member 18, and one row of three half sections of the inside support structures 14 each having one half of a cleat 22 indicated as 22A. When the two sheets are attached together to form a platform frame, the row of half sections of cleats 22A and 22B are attached to form the cleats within the inside support structures 14. Furthermore, the inboard edges of the halves of the deck structure 12*a* and 12*b* should preferably meet in the center of the shipping platform to form a flat, smooth deck surface, as shown in FIG. 1. However, as shown in FIG. 2, the shipping platform may be designed that the deck sections may not meet.

Also, as shown in FIGS. 1–2*a*, the direction of corrugation or grain should run in the direction marked I. This wrap around configuration provides added strength to the corners and edges of the support structures, the cleats, and the stretch wrap retention tabs.

Generally, the support structures, as shown in FIGS. 1 and 3 are constructed as shown in FIGS. 3–7. When forming the support structure, the cleat sections 22*a* and 22*b* are folded upward as shown in FIG. 3*a* until the cleat sections are standing upright as shown in FIG. 3*b*. The cleats 22 may be fixed in this position by adhesive, stapling, or any other means known in the art. The sides 14*a*, 14*b*, 16*a*, and 16*b* of the support structures are then folded upward to create the side walls of the support structures 14 and 16, and thereby form open-ended cavities defined within the support structures. The vertical support core 24 is placed within the open-ended cavity to provide primary support to the support structures. The vertical support cores 24 may be frictionally fit into place or may be fixed in place by adhesive means or any other means known in the art.

Additionally, the ends of the cleats 22 are preferably designed to be recessed into the cavity equal to the thickness of the wall of the vertical support core to allow for the placement of the vertical support core 24 over the cleat 22. However, as shown in FIG. 7, the cleat 22 preferably should still be long enough to provide a snug fit between the end walls of the vertical support core 24 allowing for maximum shear strength protection should the vertical structure be struck laterally by a forklift tine or other object.

Figure 7:
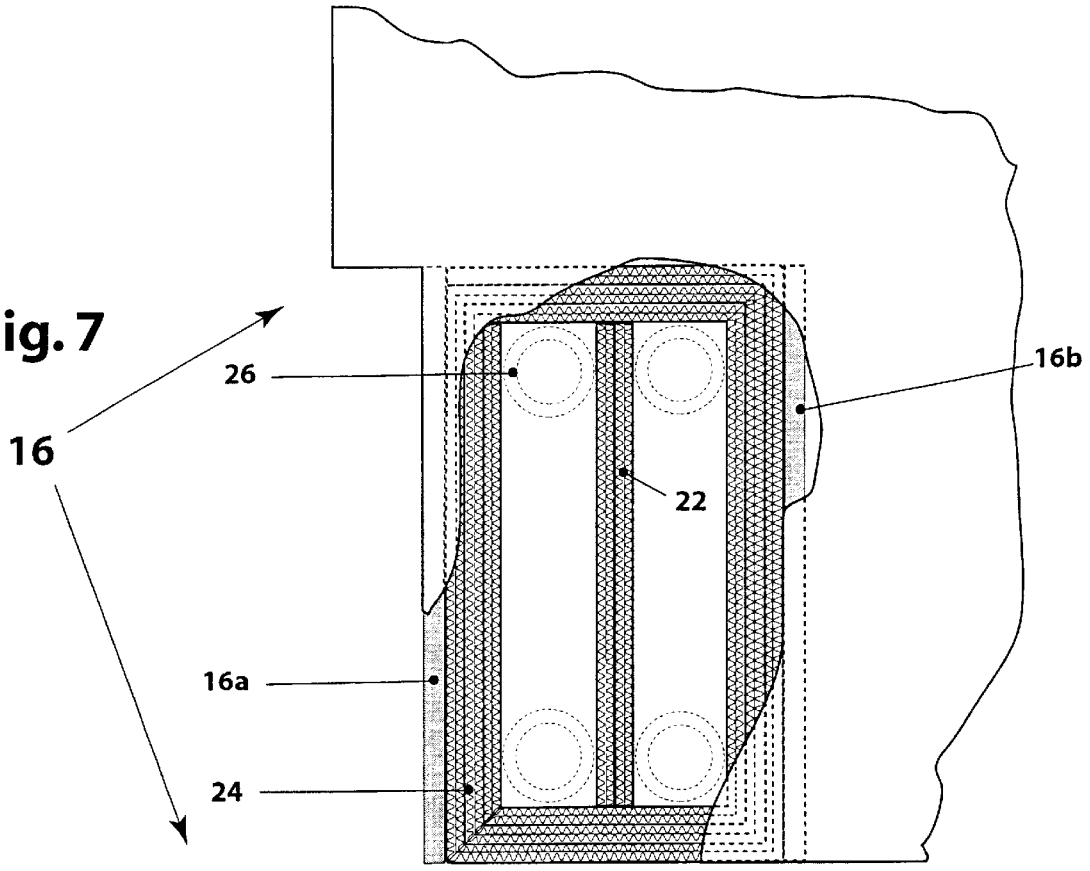
FIG. 7 is an overhead cutaway view of the support structure with vertical support core and an optional core of the embodiment represented in FIG. 1.

Furthermore, as shown in FIG. 7, one or more optional cores 26 may be added within the confines of the vertical support core 24 in some or all of the support structures 14 and 16 to provide additional support when heavy loads are to be shipped. The optional cores may be constructed from any suitable material and have any suitable shape. One such example is shown in FIG. 7. The optional core 26 is shown as a circular cylindrical tube, preferably made of tightly wound paper. The optional cores 26 may be fixed in place by any means known in the art including frictionally fixing them in place.

As shown, the support structures 14 and 16 are constructed and arranged underneath deck structure 12 to raise the platform 10 off of the ground, thereby allowing access to the platform by fork lift and pallet jack. Fork lifts, pallet jacks, conveyors, or other such equipment are commonly used to move shipping platforms, and therefore, it is within the purview of this invention that the number, shape, construction and arrangement of the support structures 14 and 16 be changed to allow such equipment to lift the platform 10.

For example, in FIG. 1, the shipping platform 10 has a four-way entry configuration formed by the alignment of nine support structures 14 and 16 that are generally rectangular in shape and are located in three spaced rows and three spaced columns. The rows provide access on two sides of the platform and provide space on the underside of the platform for the tines of a fork lift, while the columns allow access from the two other sides of the platform.

Figure 11:
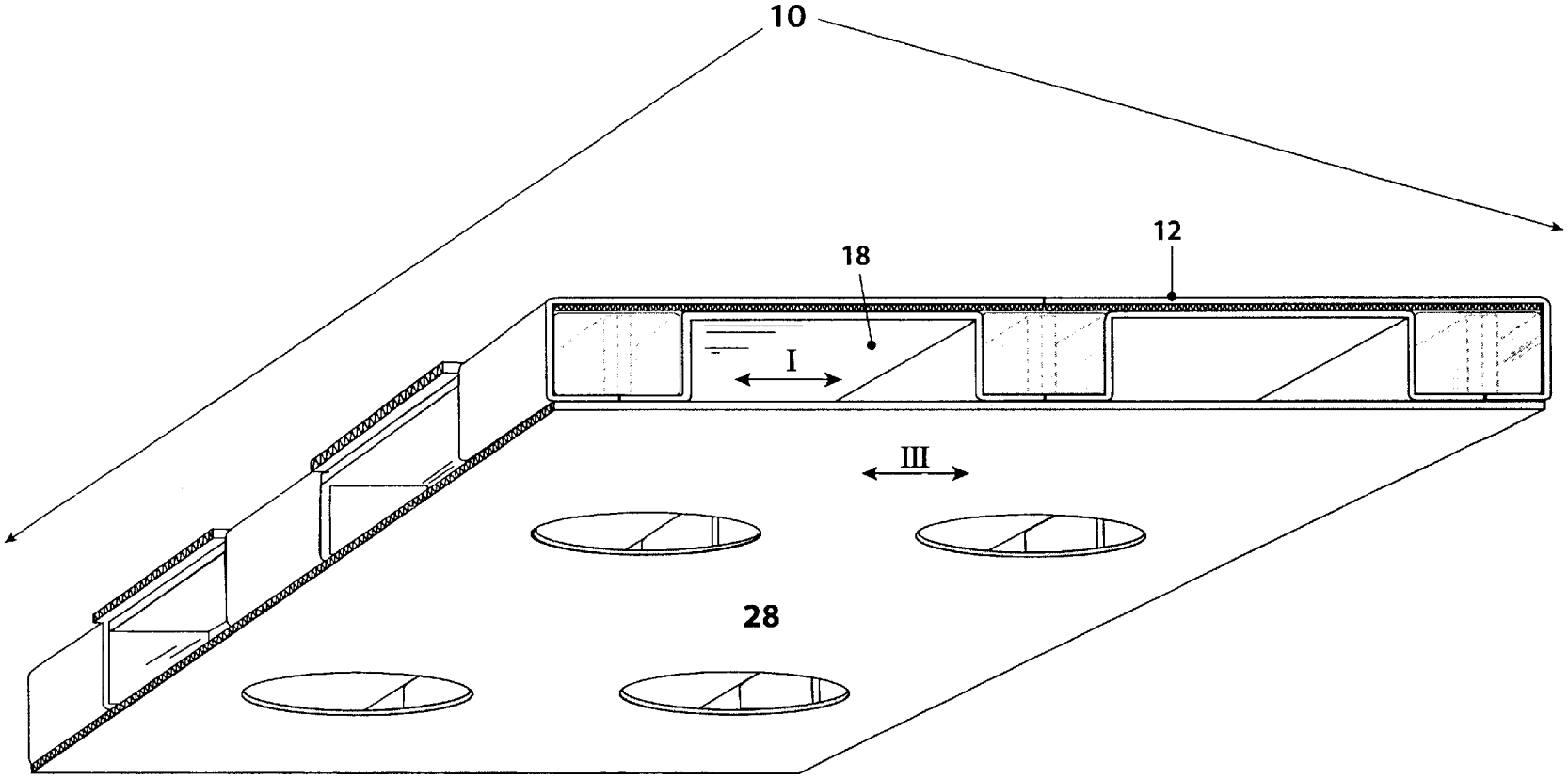
FIG. 11 is an upward angled perspective view of the shipping platform of the embodiment represented in FIG. 1 having an optional bottom deck with die-cut openings to accommodate four-way entry of a pallet jack.
Figure 12:
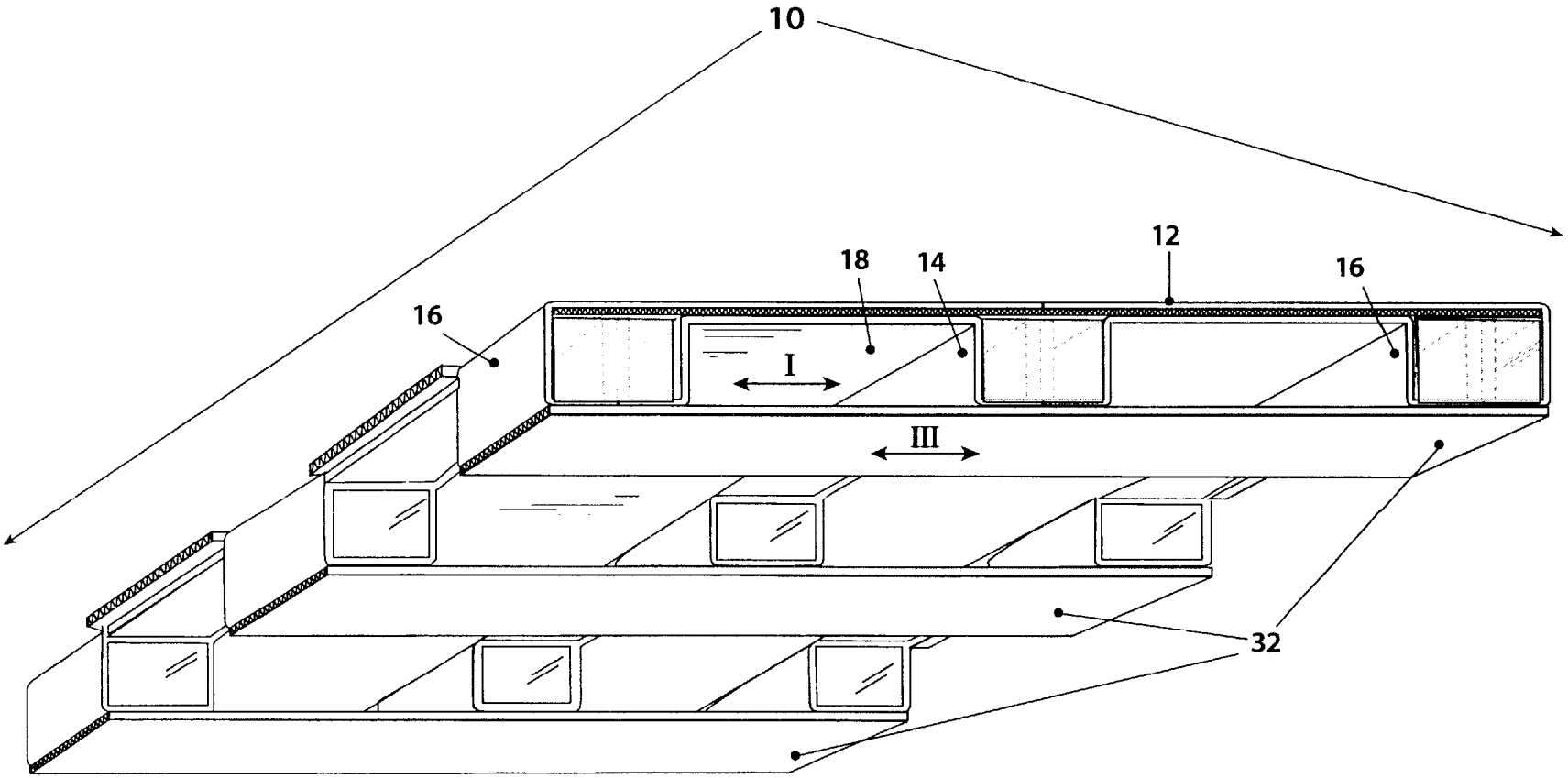
FIG. 12 is an angled perspective view of the shipping platform of the embodiment represented in FIG. 1 having deck runners.

As shown in FIGS. 11 and 12, the shipping platform 10 may also include additional components, such as a bottom deck panel 28, that allows for use with a conveyor and may be die-cut to allow for use with a pallet jack, or other such equipment. The bottom deck panel is also useful for reducing top deck deflection and stacking two or more loaded platforms. Alternatively, bottom deck runners 32 may be attached on the bottom surfaces of the support structures 14 and 16 to provide additional directional stability and reduce deflection of the deck structure when the platform is raised by a fork lift or pallet jack. For each additional component, the preferred direction of corrugation is shown and marked as III. The runners 32 and bottom deck panel 28 also allow for greater load/weight distribution if the loaded platforms are stacked one on top of another. The runners 32 may be affixed to the shipping platform running from side to side, as shown, or from front to back.

Furthermore, an optional deck pad 30 may be placed between the deck structure 12 and the plurality of support structures 14 and 16 to provide additional strength to the deck structure 12. The pad 30 should preferably be made from the same material as the deck structure 12 and be similar in size and shape to the deck structure. The deck pad may be affixed to the platform in any means know in the art. It is preferred that the direction of corrugation of the pad be aligned perpendicular to that of the deck structure.

Figure 13:
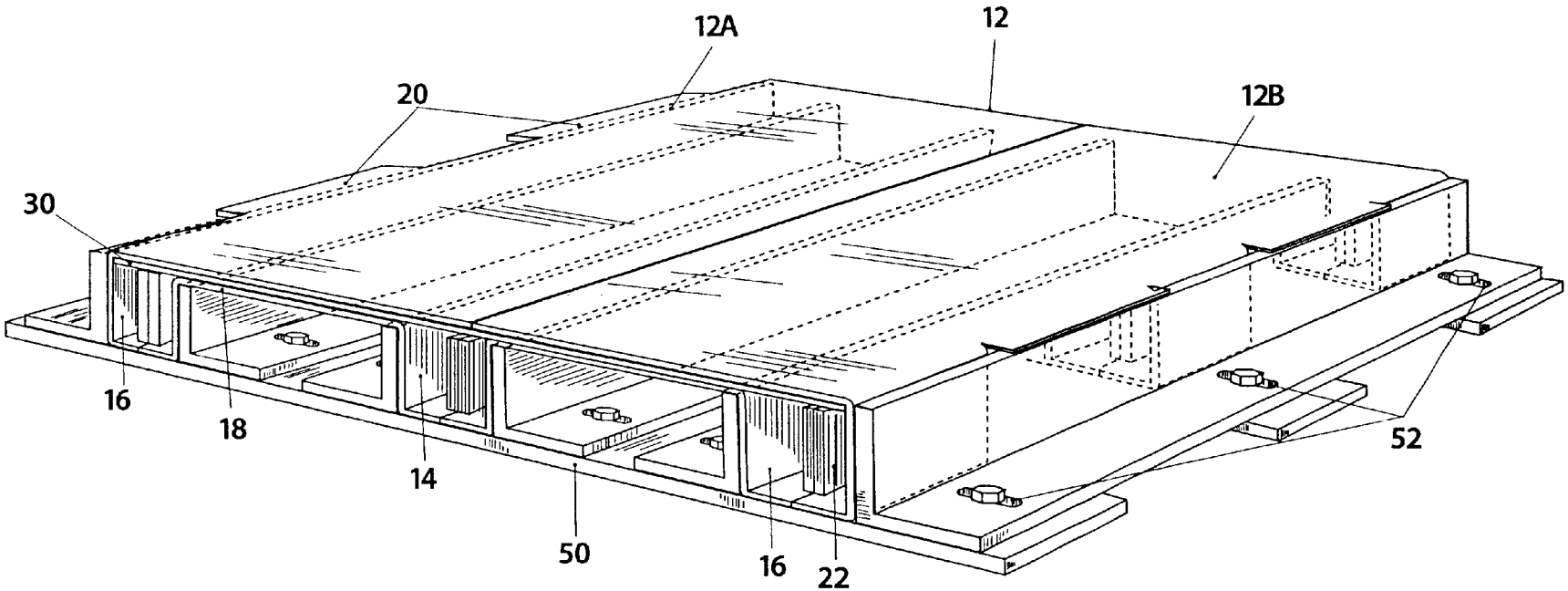
FIG. 13 is a perspective view of a shipping platform of the embodiment represented in FIG. 1 within a forming fixture.

The shipping platform of this invention may be formed using a forming fixture, as shown in FIG. 13. Preferably, the fixture should be adjustable to allow for the construction of different size and style platforms. The fixture shown has an adjustment means 52 for each side of a channel used to form the support structures. The forming fixture is preferably made from a rigid material such as metal, wood, plastic, of other such suitable materials known in the art.

The shipping platform is constructed, using the fixture, by placing the sections of the inner support structure of the platform frame into the fixture 50 which forms the inner support structures 14, thereby also forming their respective open-ended cavities and cleats 22. The sections comprising the outside support structures 16 are then formed by placing the sections into the fixture 50. Vertical support cores are placed into the cavities of the support structures.

An optional deck pad 30 may then be placed over the support structures, if desired, and the two sections of the deck structure 12*a* and 12*b* may be folded over and secured to either or all of: the deck support members 18, support structures 14 and 16, or to the deck pad 30 if used. The shipping platform may then be removed from the fixture 50. Optional components such as bottom deck runners or a bottom deck panel may then be added if desired.

Since many possible embodiments may be made of the present invention without departing from the scope thereof, it is to be understood that all matter herein set forth or shown in the accompanying drawings is to be interpreted in the illustrative and not a limiting sense.

That which is claimed is:

1. A shipping platform comprising:

a planar deck structure having an upper and a lower surface;

a plurality of support structures arranged at predetermined locations under said lower surface of said deck structure, each said support structure forming an open-ended channel cavity therein, at least one of said support structures also forming a cleat within said open-ended channel cavity therein, said planar deck structure and plurality of support structures formed from a continuous sheet of material; and at least one vertical support core placed within the open-ended channel cavity and at least partially surrounding a cleat formed in said open-ended cavity of at least one said support structure, said deck structure, plurality of support structures, and said vertical support cores being secured together.

2. A shipping platform according to claim 1, wherein at least one of said support structures has a vertically upstanding cleat formed within said open-ended channel cavity.

3. A shipping platform according to claim 2, wherein each said cleat is formed of two double wall thicknesses of material.

4. A shipping platform according to claim 1, wherein said deck structure and said support structures are formed as a unit from two sheets of material attached together to form a continuous sheet of material that is manipulated to form said deck and support structures.

5. A shipping platform according to claim 1, wherein said deck structure is further comprised of at least one stretch wrap retention tab.

6. A shipping platform according to claim 1, wherein an optional core is placed in at least one support structure and within said vertical support core.

7. A shipping platform according to claim 1, wherein said material is die-cut into an irregular shape having at least two rectangular portions.

8. A shipping platform according to claim 1, wherein a deck pad is placed between said deck structure and said support structures.

9. A shipping platform according to claim 1, wherein a bottom deck panel is attached to said support structures.

10. A shipping platform according to claim 1, wherein at least two bottom deck runners are applied across the bottoms of and between at least some of said support structures.

11. A platform frame constructed and arranged to form a shipping platform, said platform frame comprising one or more sheets of material forming a planar sheet, said planar sheet having fold lines and a predetermined shape, constructed and arranged to form a shipping platform having a planar deck structure and at least one support structure forming an open-ended channel cavity therein and at least one of said support structures forming a cleat in said open-ended channel cavity when said platform frame is folded along said fold lines, and at least one vertical support core positioned around said cleat and within said open-ended channel cavity.

12. A platform frame according to claim 11, wherein said platform frame and fold lines further define a portion of said platform frame to form a vertically upstanding cleat in at least one said support structure when said platform frame is folded along said fold lines.

13. A method of constructing a shipping platform comprising the following steps:

providing one or more sheets of material forming a planar sheet having a plurality of fold lines for forming a platform frame;

folding a portion of said planar sheet to form a plurality of support structures, wherein each said support structure forms an open-ended channel cavity therein, at least one said support structure forming a cleat in said open-ended channel cavity;

providing at least one vertical support core;

placing said at least one vertical support core in at least one said support structure and at least partially surrounding a cleat formed in said open-ended cavity;

folding the remaining portion of said platform frame over said plurality of support structures to form a planar deck structure; and securing said deck structure, said vertical support cores, and said plurality of support structures together.

14. The method according to claim 13 wherein, the method further comprises the steps of:

providing a plurality of planar sheets of material; creating fold lines on said plurality of sheets; and attaching said plurality of sheets together to form a platform frame.

15. The method according to claim 14 wherein, the method further comprising the steps of;

providing a forming fixture having channels therein, constructed and arranged to form the platform frame into the shipping platform; and placing the platform frame thereon, prior to folding said frame.

16. The method according to claim 14 wherein, the method further comprises the steps of; inserting a deck pad between said platform structure and said support structures prior to securing said platform and said support structures.

17. A shipping platform according to claim 1, wherein said vertical support core is disposed horizontally around said cleat to surround said cleat.

18. A shipping platform according to claim 17, wherein said cleat is vertically upstanding and said vertical support core completely surrounds said cleat.

19. A shipping platform, comprising;

one or more sheets of material forming a planar sheet, said planar sheet having fold lines and a predetermined shape, constructed and arranged to be folded to form said shipping platform having a planar deck structure and at least one support structure forming an open-ended channel cavity therein and at least one of said support structures forming a vertically upstanding cleat in said open-ended channel cavity when said platform frame is folded along said fold lines; and at least one vertical support core positioned horizontally around and completely surrounding said cleat and within said open-ended channel cavity.

* * * * *